US006334754B1

(12) United States Patent
Kabasawa

(10) Patent No.: US 6,334,754 B1
(45) Date of Patent: Jan. 1, 2002

(54) TURBOMOLECULAR PUMP

(75) Inventor: Takashi Kabasawa, Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/338,310

(22) Filed: Jun. 22, 1999

(30) Foreign Application Priority Data

Jun. 23, 1998 (JP) ..... 10-192433

(51) Int. Cl.[7] ..... F01D 1/36; F04D 19/04
(52) U.S. Cl. ..... 415/90; 415/210.1
(58) Field of Search ..... 415/90, 189, 190, 415/191, 193, 208.2, 209.1, 209.2, 210.1; 417/423.4

(56) References Cited

U.S. PATENT DOCUMENTS

| | | | | |
|---|---|---|---|---|
| 2,918,208 A | * 12/1959 | Becker | 415/90 |
| 4,655,678 A | * 4/1987 | Miki | 415/90 |
| 5,158,426 A | * 10/1992 | Casaro et al. | 415/191 |
| 5,358,373 A | * 10/1994 | Hablanian | 415/90 |
| 5,542,825 A | * 8/1996 | Perrillat-Amede et al. | 417/423.4 |

FOREIGN PATENT DOCUMENTS

| | | | |
|---|---|---|---|
| DE | 29715035 | 10/1997 | |
| EP | 0442556 | 8/1991 | |
| JP | 62-173594 | 11/1987 | |
| JP | 3-168387 | * 7/1991 | 417/423.4 |
| JP | 4-59393 | 5/1992 | |
| JP | 5106588 | 4/1993 | |
| JP | 5157090 | 6/1993 | |
| JP | 7150894 | 6/1995 | |
| JP | 8-54067 | 2/1996 | |
| JP | 9-14185 | 1/1997 | |
| SU | 1204805 | * 1/1986 | 415/90 |

OTHER PUBLICATIONS

Patent Abstracts of Japan, vol.008, No. 201(M–325), Sep. 14, 1984.
Patent Abstracts of Japan, vol.016, No. 184(M–1243), May 6, 1992.

* cited by examiner

*Primary Examiner*—Christopher Verdier
(74) *Attorney, Agent, or Firm*—Adams & Wilks

(57) ABSTRACT

A turbomolecular pump comprises a casing, a rotor having a rotor blades arranged in multiple stages in the casing axially thereof, and a stator having stator blades arranged in multiple stages and alternately located between the rotor blades. Each of the stator blades has an inner ring portion, an outer ring portion spaced-apart from the inner ring portion, and blades connected between the inner and outer ring portions along a circumferential direction thereof. Each of the blades has a first end connected to an outer peripheral edge of the inner ring portion and a second end opposite the first end connected to an inner peripheral edge of the outer ring portion. A reinforcement member is disposed on the inner ring portion of each of the stator blades along the entire circumference of the inner ring portion for reinforcing the stator blade.

21 Claims, 11 Drawing Sheets

TURBOMOLECULAR PUMP

BACKGROUND OF THE INVENTION

1. Field of the Invention

The present invention relates to a turbomolecular pump, and more particularly to a turbomolecular pump having improved stator blades.

2. Description of the Related Art

A turbomolecular pump is widely used as a vacuum apparatus for a semiconductor manufacturing equipment.

The turbomolecular pump has stator blades and rotor blades which are disposed on a stator portion and a rotor portion, respectively, in a multistage arrangement in an axial direction, and the rotor portion is rotated with a motor at high speed so that a vacuum (exhaust) action is performed.

FIGS. 11(*a*) to 11(*c*) show the structures of the rotor blade and the stator blade of the turbomolecular pump described above. FIG. 11(*a*) shows an arrangement between the rotor blade and the stator blade, FIG. 11(*b*) is a sectional perspective view showing a rotor that is cut along upper and lower planes of the rotor blade, and FIG. 11(*c*) is a perspective view showing a part of the stator blade.

As shown in FIG. 11(*a*), the turbomolecular pump is composed of a rotor 60 and a stator 70 that are fixedly disposed to rotor axes rotating at high speed.

The rotor 60 is composed of a rotor body 61 that accommodates a motor and magnetic bearings inside thereof, a rotor ring portion 64 arranged at an outer circumference of the rotor body 61, and a plurality of blades 63 provided to the rotor ring portion 64 radially in a radial direction and tilted at a predetermined angle with respect to the rotational axis.

On the other hand, the stator 70 is composed of a spacer 71 and a stator blade 72 that are arranged between rotor blades 62 at the respective stages, while being supported its outer circumferential side between the spacers 71 and 71.

The spacer 71 is a cylindrical shape having stepped portions, and the length of each stepped portion in an axial direction, located inside thereof, is varied in accordance with the intervals between the respective stages of the rotor blades 62.

The stator blade 72 is composed of an outer ring portion 73, part of outer circumferential portion of which is sandwiched by the spacers 71 in circumference direction, an inner ring portion 74, and a plurality of blades 75 both ends of which are supported radially with a predetermined angle by the outer ring portion 73 and the inner ring portion 74. The inner diameter of the inner ring portion 74 is formed to have a larger size than the outer diameter of the rotor body 61 so that an inner circumferential surface 77 of the inner ring portion 74 and an outer circumferential surface 65 of the rotor body 61 do not contact with each other.

In order to arrange the stator blade 72 between the rotor blades 62 at the respective stages, each stator blade 72 is divided into two parts in circumference. The stator blade 72 is made from a thin plate such as a stainless or aluminum thin plate that is divided into two. An outer portion having a semi-ring profile and portions for blades 75 of the stator blade 72 are cut out by means of etching from the thin plate, and the portions for blades 75 are folded by means of press machining to have a predetermined angle. Thus, the shape shown in FIG. 11(*c*) is obtained.

In the thus formed turbomolecular pump, the rotor 60 is designed to be rotated with a motor at several tens of thousands r.p.m., so that an exhaust action is effected from the upstream side to the downstream side of FIG. 11(*a*)

In such conventional turbomolecular pump, since the support of the stator blades 72 by a spacer 71 is carried out with a cantilever configuration and the stator blades 72 are divided into two parts in circumference, large deflection would occur in the case that excess loads were applied to the stator blades 72. In particular, in the stator blades 72 formed by means of press machining, since the thickness of the plate is thin, there have been cases where the open end on the center side was largely deflected at the portion divided into two parts.

For that reason, in the case where a large fluctuation occurred in a load of gas due to malfunction, etc. of valves attached to a vacuum chamber, the stator blades were caused to largely deflect with the result that, in the worst case, blades 75 of the stator blades were brought into contact with blades 63 of the rotor blades were damaged.

Further, in the case where such a structure was employed that a magnetic bearing was used for the rotor axis, there also occurred the case in which the stator blades 72 and the rotor blades 62 broken when brought into contact with each other due to vibration generated at the time of a trouble with the magnetic bearing device or of a touch-down of a touch down bearing upon a power failure.

SUMMARY OF THE INVENTION

The present invention has been made to solve the above-mentioned problems inherent in the conventional turbomolecular pump, and therefore has a primary object of the present invention to provide a turbomolecular pump with stator blades having a structure in which deflections are not relatively occurred.

Further, a secondary object of the present invention is to provide a turbomolecular pump with stator blades having a structure in which deflections are not relatively occurred.

Further, a secondary object of the present invention is to provide a turbomolecular pump with stator blades having a structure in which breakage of the stator blades are hardly occurred even if the stator blades are brought into contact with rotor blades due to deflections.

In order to attain the primary object of the present invention, according to the present invention, a reinforcement portion is arranged to the inner ring portion of each stator blade.

Further, according to the present invention, the reinforcement portion is constructed of a rib structure formed in the inner ring portion of the stator blade.

Still further, according to the present invention, said reinforcement portion is constructed of engagement means formed at end portions of the divided inner ring portion of the stator blade for engaging one end portion of the divided inner ring portion of said stator blade and the other end portion of the divided inner ring portion facing thereto.

In order to attain the secondary object of the present invention, according to the present invention, the blades of the stator blades at the respective stages comprise a multilayer of plural pairs of blades overlapped with each other, and the phases of the divided positions at the respective layers are shifted with each other.

Further, according to the present invention, the blades of the rotor blades at the respective stages are provided to the rotor ring portion that is disposed to the rotor corresponding with the stage; and an outer diameter of the inner ring portion of the blades of the stator blades is smaller than an outer diameter of the rotor ring portion.

Further, according to the present invention, steps are formed at the outer ring portion so that the blades of the stator blades are allowed to contact with the outer ring portion.

BRIEF DESCRIPTION OF THE DRAWINGS

In the accompanying drawings:

FIG. 3(*b*) is a cross-sectional view showing the engagement state of FIG. 3(*a*);

FIG. 4(*b*) is a cross-sectional view showing the engagement state of FIG. 4(*a*);

DETAILED DESCRIPTION OF THE PREFERRED EMBODIMENTS

Figure 1:
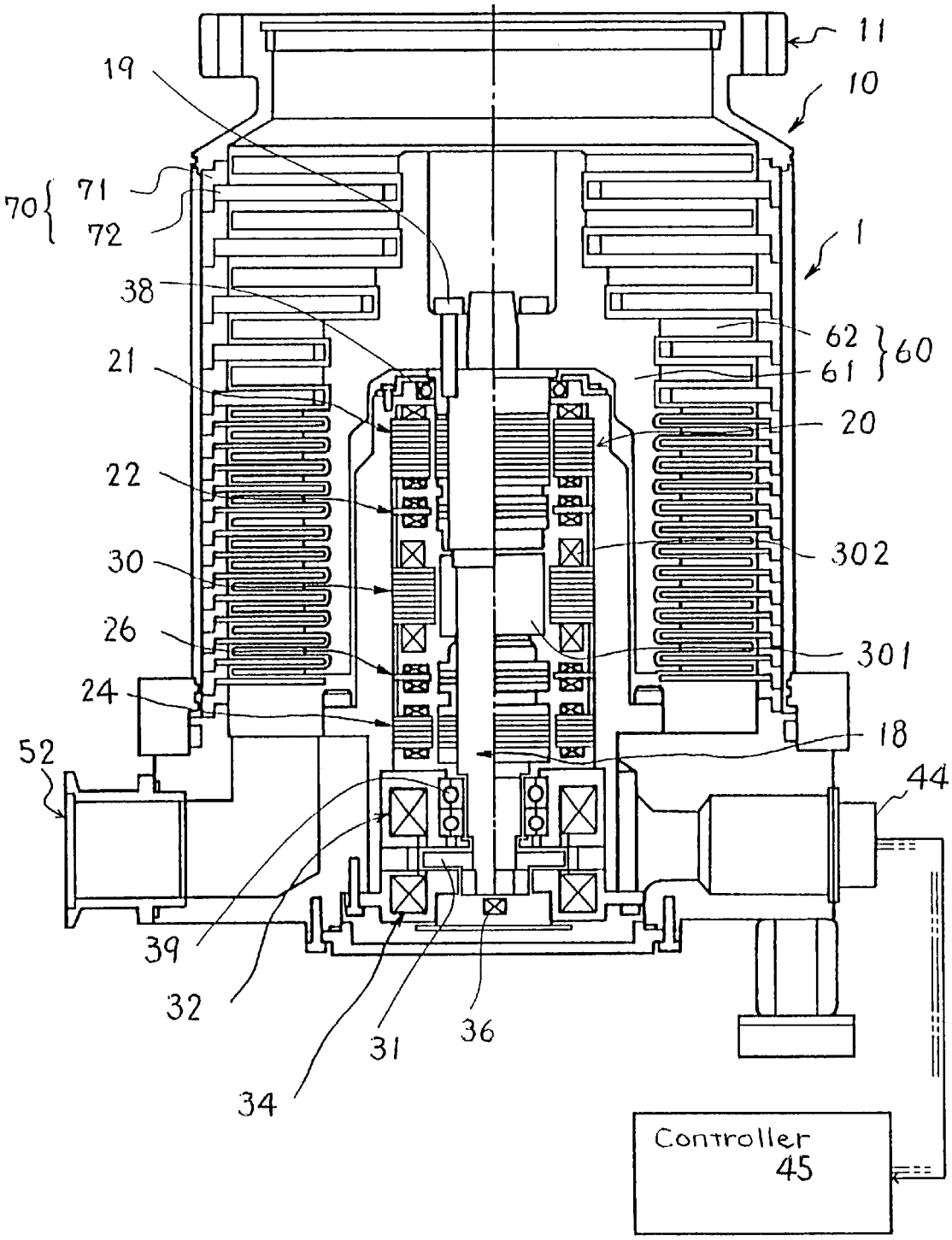
FIG. 1 is a cross-sectional view showing the entire structure of a turbomolecular pump according to an embodiment of the present invention.
Figure 2A:
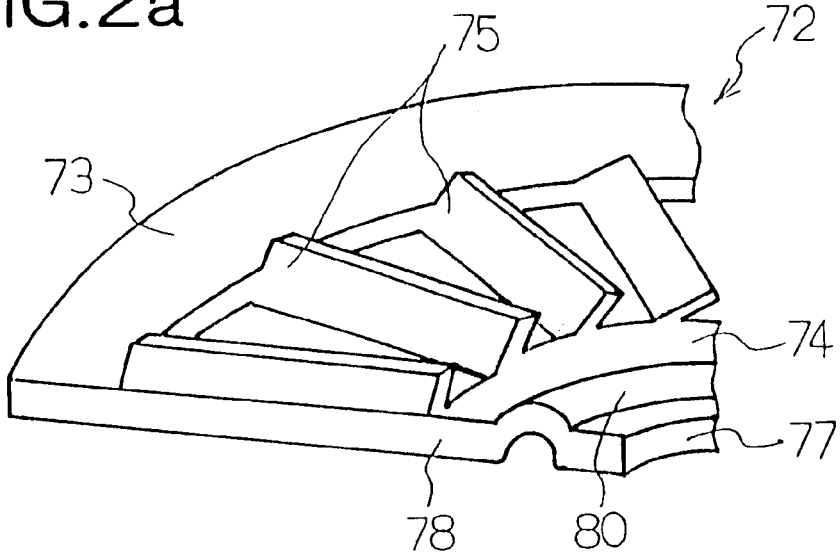
FIG. 2 shows the structure of a stator blade according to a first embodiment of the present invention, in which FIG. 2(*a*) is a partially perspective view of the stator blade, and FIG. 2(*b*) to 2(*e*) show rib structure portions of the stator blade in which various shapes are employed.
Figure 2B:
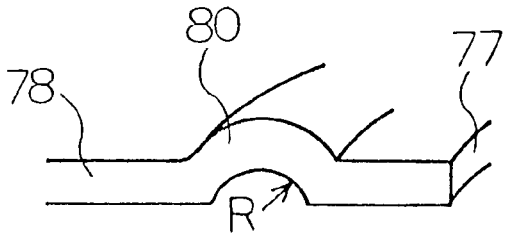
Figure 2C:
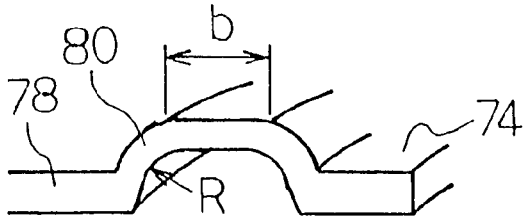
Figure 2D:
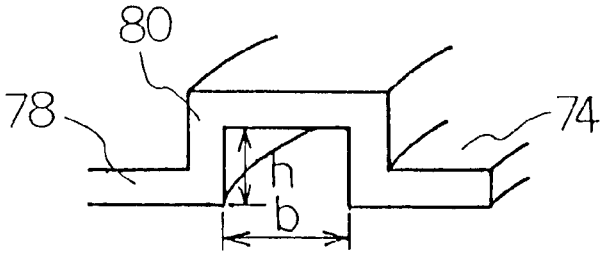
Figure 2E:
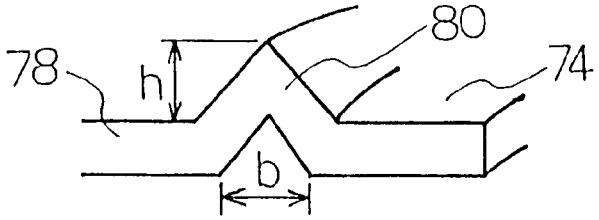

Hereinafter, detailed descriptions will be made of the preferred embodiments of the present invention with reference to FIG. 1 to FIG. 10.

(1) Outline of Embodiments

According to a first embodiment of the present invention, a rib structure is employed to an inner ring portion 74 of a stator blade 72. As a specific rib structure, a variety of shapes such as a semicircular-shape, a semiellipse-shape, a U-shape, or reversed V-shape in cross-section in a radial direction may be employed. Those shapes may be formed by means of a press machining, or by attaching with welding, etc.

According to a second embodiment of the present invention, claws are formed by means of folding or welding, etc., at the connecting portions of two-divided stator blades 72. As a result, rigidity is enhanced at the two-divided portion where the stator blades 72 are faced to each other, which hardly causes deflection of the blades.

According to a third embodiment of the present invention, the pair of the stator blades 72 each consisting of two-divided stator blades are overlapped to form a two-layer structure. Further, phases of the two-divided positions of the stator blades in the respective layers are shifted by 90° to each other, According to a fourth embodiment of the present invention, there is employed a structure in which even in the case where the stator blades 72 and the rotor blades 62 are brought into contact with each other, blades 75 of the stator blades (hereinafter simply referred to as "blades S") and blades 63 of the rotor blades (hereinafter simply referred to as "blades R"), which form planes of discontinuity and are the weakest portions in the structure, are prevented from contacting with each other. Specifically, the length of the blades S 75 in a radial direction is lengthened (extend) inwardly, so that in the case where the stator blades 72 are deflected, the top end portions 76 of the blades S 75 on the center side is brought into contact with a rotor ring portion 64 which is a plane of continuity of the rotor blades 62, thereby preventing the blades S 75 from contacting with the blades R 63. Further, an abutting portion (leg portion) is provided to the inner ring portion 74 of each stator blade 72, with the result that even in the case where the stator blades 72 are largely deflected, the leg portion is allowed to contact with the rotor ring portion 64. With taking a structure described above, it can be prevented both planes of discontinuity (blades S 75 and blades R 63) from directly contacting with each other, with the result that the stator blades 72 and the rotor blades 62 are hardly damaged.

(2) Details of Embodiments

Detailed descriptions of preferred embodiments of the present invention will be made hereinafter with reference to FIG. 1 to FIG. 10. It is to be noted that, in the present embodiments, the same reference numerals are used to explain the same components in the conventional turbomolecular pump shown in FIG. 11, and the descriptions thereof are appropriately omitted. Only different portions between the conventional structure and the present embodiments are described.

FIG. 1 is a cross-sectional view showing the entire structure of a turbomolecular pump according to an embodiment of the present invention.

A turbomolecular pump 1 above is installed, for example, in semiconductor manufacturing equipment for exhausting a process gas from a chamber, etc. In this example, a flange 11 is formed at the top end portion of a casing 10, and is allowed to join the semiconductor manufacturing equipment, etc., with bolts.

As shown in FIG. 1, the turbomolecular pump 1 is provided with a rotor shaft 18 that is substantially cylindrical and is arranged at the center portion of the casing 10. Arranged to the outer periphery of the rotor shaft 18 is a rotor body 61 having a substantially inverted U-shaped in cross-section to be attached to the top portion of the rotor shaft 18 with bolts 19. Around the outer periphery of the rotor body 61, the rotor ring portions 64 are arranged in multistage manner, and the rotor blades 62 are arranged to the respective rotor ring portions 64. The rotor blades 62 at the respective stages include a plurality of the blades 63 with an open end.

Further, the turbomolecular pump 1 is provided with the rotor 60 and the stator 70.

The stator 70 is constructed of the plurality of stator blades 72 and the cylindrical spacers 71 having stepped portions. The stator blades at the respective stages are divided into two as described later, and are inserted between the rotor blades 62 at the respective stages outwardly to be assembled. The stator blades 72 at the respective stages are sandwiched in a circumferential direction at the outer ring portion 73 between the spacers 71 and 71, respectively, thereby being retained between the rotor blades 62.

The stator 70 is fixedly disposed to the inner periphery of the casing 10.

The rotor blades 62 and the stator blades 72 according to the present embodiment serve as an exhaust stage, an intermediate stage, and a compression stage from the upstream thereof. It should be noted that the present invention is not limited to a three-stage structure consisting of the exhaust, intermediate, and compression stages, and a variety of structures may be employed such as a two-stage structure consisting of the exhaust stage and the compression stage, a two-stage structure in which each stage plays another function, and a structure with no limitation in the function of each stage.

The turbomolecular pump 1 further includes a magnetic bearing 20 for supporting the rotor shaft 18 with magnetic force, and a motor 30 for generating torque to the rotor shaft 18.

The magnetic bearing 20 includes radial electromagnets 21 and 24 for generating a magnetic force in a radial direction to the rotor shaft 18, radial sensors 22 and 26 for detecting the position of the rotor shaft 18 in a radial direction, axial electromagnets 32 and 34 for generating a magnetic force in an axial direction to the rotor shaft 18, a metal disk 31 to which force generated by the axial electromagnets 32 and 34 is acted, and an axial sensor 36 for detecting the position of the rotor shaft 18 in an axial direction.

The radial electromagnet 21 is composed of two pairs of electromagnets that are disposed so as to be orthogonal with each other. The respective pairs of electromagnets are disposed at an upper position than the motor 30 of the rotor shaft 18, while sandwiching the rotor shaft 18 therebetween.

Provided between the radial electromagnet 21 and the motor 30 are two pairs of radial sensors 22 facing with each other and sandwiching the rotor shaft 18 therebetween, and being adjacent to the radial electromagnet 21 side. The two pairs of radial sensors 22 are disposed so as to cross at right angles with each other in correspondent with two pairs of radial electromagnets 21.

Furthermore, two pairs of electromagnets 24 are similarly disposed at a lower position than the motor 30 of the rotor shaft 18 so as to be orthogonal with each other.

Between the radial electromagnet 24 and the motor 30, two pairs of radial sensors 26 are similarly provided so as to be adjacent to the radial electromagnet 24.

By supplying excitation current to these radial electromagnets 21 and 24, the rotor shaft 18 is magnetically levitated. This excitation current is controlled bin correspondence with the position detection signals from the radial sensors 22 and 26 upon the magnetic levitation. As a result, the rotor shaft 18 is secured at the prescribed position in the radial direction.

Onto the lower portion of the rotor shaft 18, a discoid metal disk 31 formed of the magnetic substance is fixed. Each one pair of axial electromagnets 32 and 34 facing with each other are disposed while sandwiching this metal disk 31 therebetween. Further, the axial sensors 36 are disposed facing with each other at the lower end portion of the rotor shaft 18.

The excitation current of the axial electromagnets 32 and 34 is controlled in correspondent with the position detection signal from the axial sensor 36. As a result, the rotor shaft 18 is secured at the prescribed position in the axial direction.

The magnetic bearing 20 includes a magnetic bearing controlling section disposed within a controller 45 for magnetically levitating the rotor shaft 18 by feedback controlling the excitation current of the radial electromagnets 21 and 24 and the axial electromagnets 32 and 34, respectively, on the basis of the detection signals of these radial sensors 22 and 26 and the axial sensor 36.

The touch down bearings 38 and 39 are disposed at the upper and lower sides of the rotor shaft 18.

In general, the rotor portion consisting of the rotor shaft 18 and respective portions attached thereto is axially supported in a non-contact state by the magnetic bearing 20 during its rotation with the motor 30. The touch down bearings 38 and 39 play a part for protecting the entire device by axially supporting the rotor portion in place of the magnetic bearing 20 when the touch down occurs.

Therefore, the touch down bearings 38 and 39 are arranged so that the inner race of the bearings 38 and 39 are in the non-contact state against the rotor shaft 18.

The motor 30 is disposed between the radial sensor 22 and the radial sensor 26 inside the casing 10 substantially at the center position of the rotor shaft 18 in the axial direction. The rotor shaft 18, the rotor 60 and the rotor blades 62 fixed thereto are allowed to rotate by applying a current to the motor 30.

An exhaust port 52 for exhausting the processed gas or the like from the semiconductor manufacturing equipment is disposed at the lower portion of the casing 10 of the turbomolecular pump 1.

Also, the turbomolecular pump is connected to the controller 45 through the connector 44 and the cable.

FIGS. 2(*a*) to 2(*e*) show the structure of the stator blade 72 according to the first embodiment of the present invention.

As shown in FIG. 2(*a*), the stator blade 72 is constructed of an outer ring portion 73 part of the outer circumference side of which is sandwiched in the circumferential direction by the spacers 71, the inner ring portion 74, and a plurality of blades 75 both ends of which are radially supported with a predetermined angle by the outer ring portion 73 and the inner ring portion 74. The inner diameter of the inner ring portion 74 is formed larger than the outer diameter of the rotor body 61, so that the inner circumferential plane 77 of the inner ring portion 74, and the outer circumferential plane 65 of the rotor body 61 do not contact with each other (refer to FIG. 11(*a*)).

A rib structure portion 80 that functions as the reinforcement member is formed at the inner ring portion 74. This rib structure portion 80 is formed in the circumferential direction from an end face 78 of the two-divided inner ring portion 74 to the end face 78 on the other side. The rigidity with respect to the deflection of the inner ring portion 74 can be enhanced by the provision of the rib structure portion 80.

The stator blade 72 is made from a thin plate such as a stainless or aluminum thin plate. An outer portion having a semi-ring profile and portions for blades 75 of the stator blade 72 are cut out by means of etching from the thin plate, and the portions for blades 75 are folded by means of press machining to have a predetermined angle. Then, the rib structure portion 80 is press-machined, and to thereby form the stator blades 72 shown in FIG. 2(*a*) is obtained.

As the specific shape (sectional shape in a radial direction) of the rib structure portion 80, though it is optional, it is possible to employ a variety of shapes such as a semicircular-shape with a radius R (FIG. 2(*b*)), a semiellipse-shape having a plane portion with the length of b in the radial direction and being chamfered with the radius R (FIG. 2(*c*)), a U-shape with the length of b and the height of h in the radial direction (FIG. 2(*d*)), or a reversed V-shape with the height of h and the width of b (FIG. 2(*e*)) and the like.

Further, in FIGS. 2(*b*) to 2(*e*), as the rib structure portion 80, the shapes that are press-machined so as to protrude in the upward direction of the drawings are shown. However, the press machining may be conducted so that the rib structure portion protrudes in the downward direction of the drawings.

In the stator blades 72 of the first embodiment of the present invention, the description was made of the case in which in order to decrease the amount of deflection of the blades in an axial direction, the rib structure portion 80 was formed by press machining as reinforcement portion in the inner ring portion 74. However, other structure may be employed as the reinforcement portion.

For example, the reinforcement member may be a separate structure which can be fixed to the inner ring portion 74 in a circumferential direction by welding or the like from one end face 78 of the two-divided inner ring portion 74 to the end face 78 on the other side. As the shape of the reinforcement member in cross-section in a direction that is orthogonal to the longitudinal direction of the reinforcement member, a variety of shapes such as square, triangle, semicircular, or semiellipse may be employed.

Figure 3A:
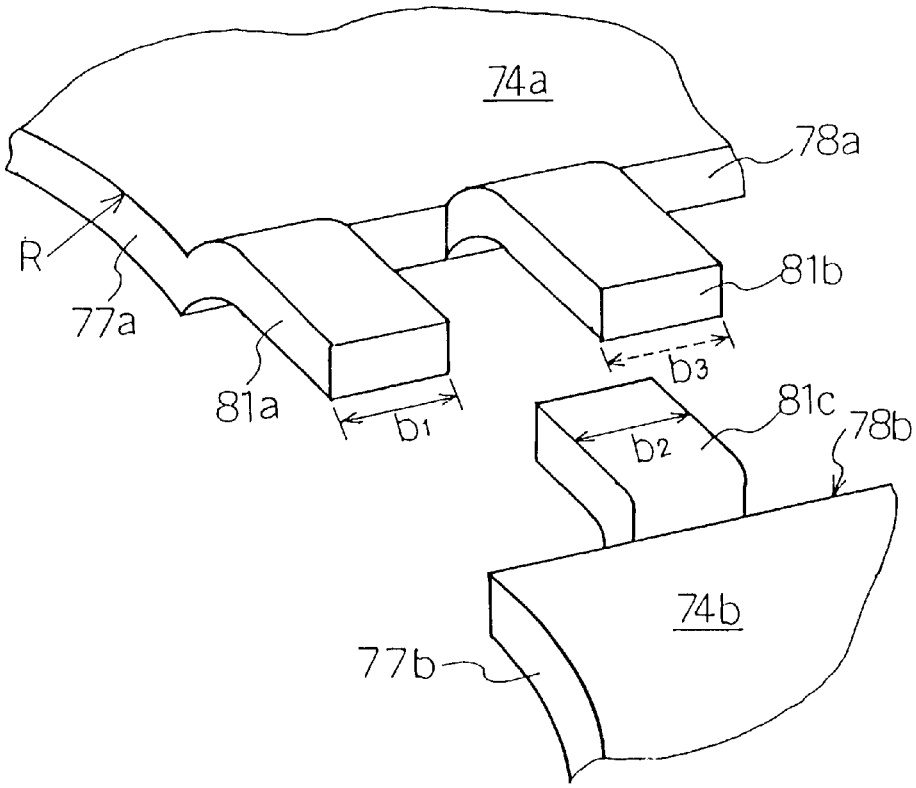
FIG. 3 shows the structure of a stator blade according to a second embodiment of the present invention, in which FIG. 3(*a*) is a perspective view showing both end portions of inner ring portions facing to each other.
Figure 3B:
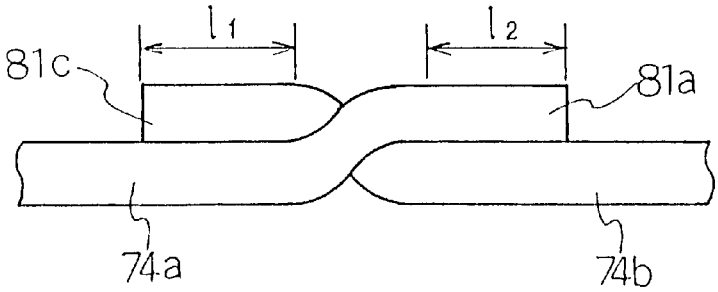

FIGS. 3(*a*) and 3(*b*) shows the structure of the stator blade 72 according to a second embodiment of the present invention, in which both end portions of inner ring portions facing to each other are shown.

In FIGS. 3(*a*) and 3(*b*), one end out of a pair of two-divided inner ring portions 74 is denoted by reference symbol 74*a,* and the other end is denoted by reference symbol 74*b*. Further, if a right side end portion of the both inner ring portions 74*a* and 74*b* viewed from the rotor axis 18 side is assumed as one end portion, and a left side end portion is assumed as the other end portion, the shapes of the one end portion and the other end portion of the inner ring portion 74*a* are formed identical to that of the inner ring portion 74*b*. FIG. 3(*a*) shows the one end portion of the inner ring portion 74*a* and the other end portion of the inner ring portion 74*b*.

Figure 4A:
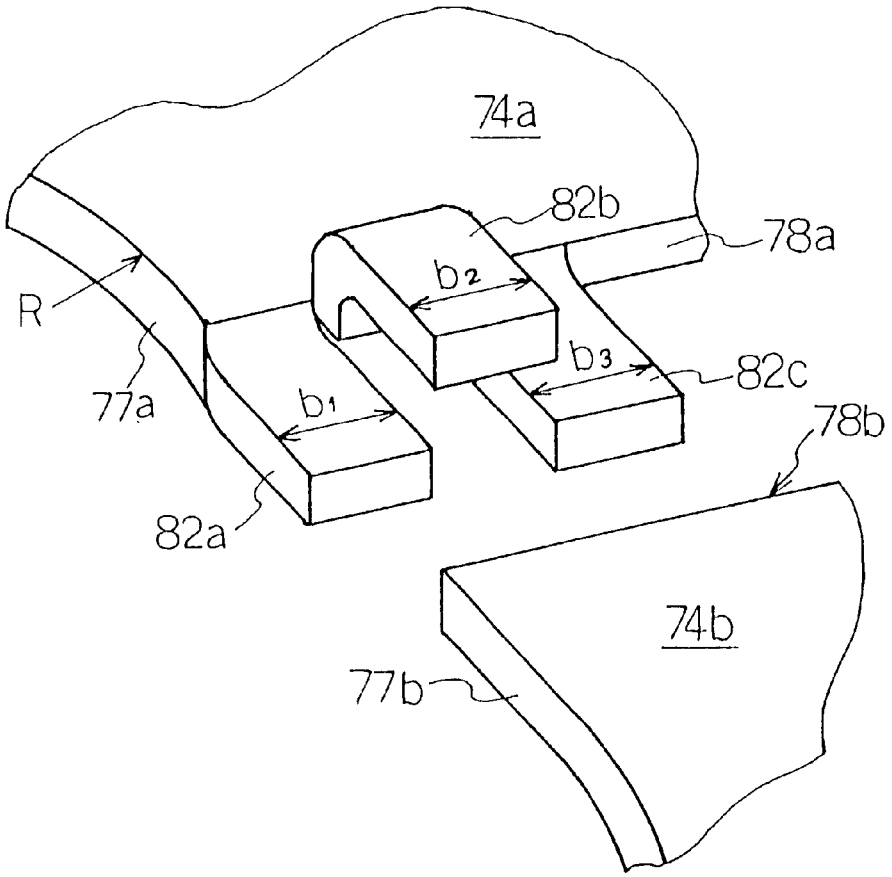
FIG. 4 shows the structure of the stator blade according to a first modification example of the second embodiment of the present invention, in which FIG. 4(*a*) is a perspective view showing both end portions of the inner ring portions facing to each other.
Figure 4B:
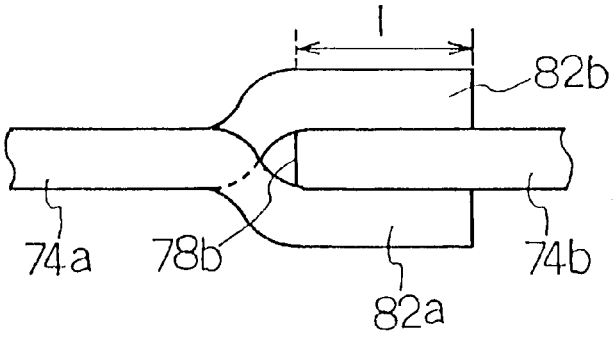
Figure 5:
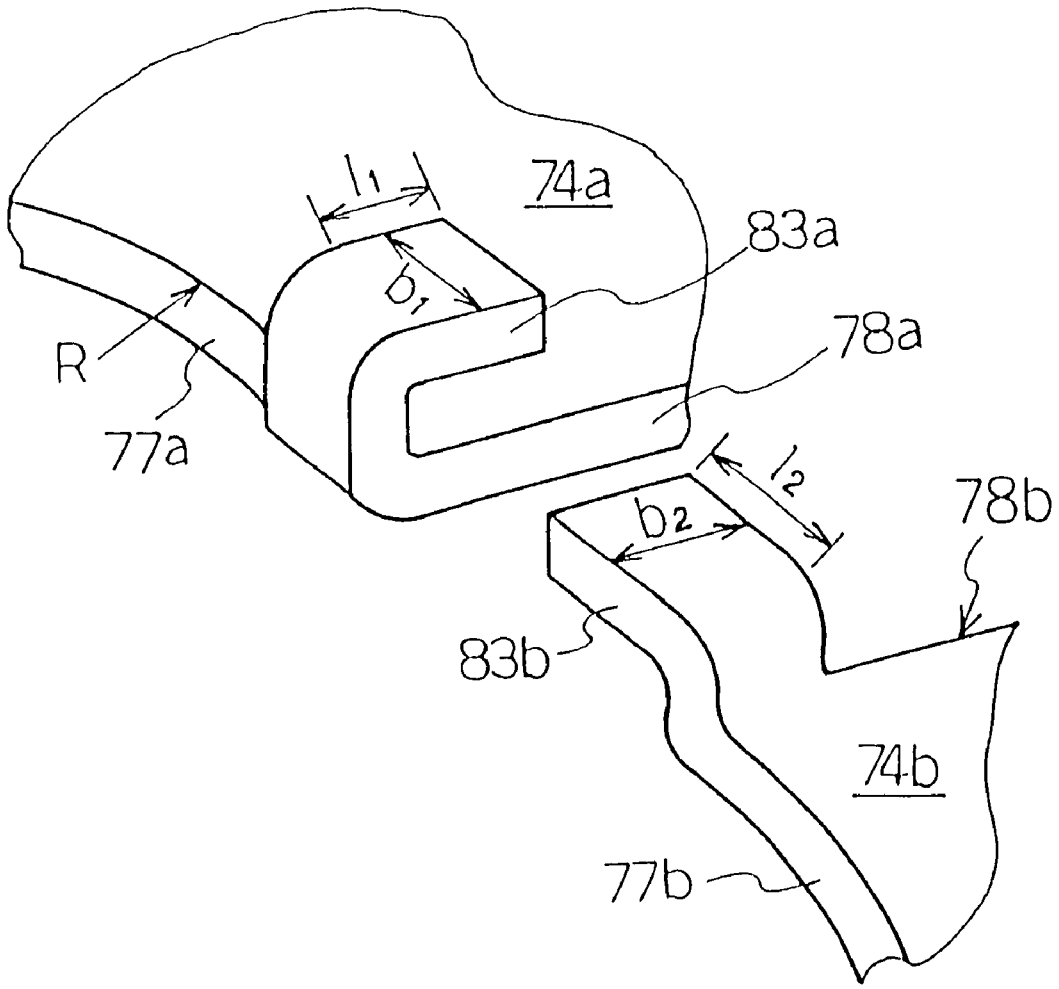
FIG. 5 is a perspective view showing both end portions of the inner ring portions of the stator blade facing to each other according to a second modification example of the second embodiment of the present invention.
Figure 6A:
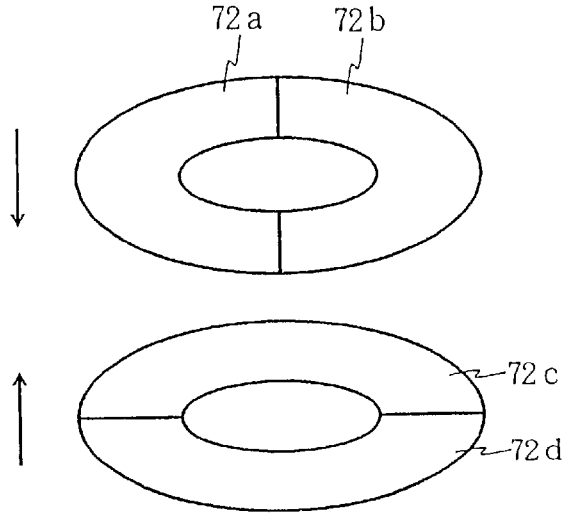
FIG. 6 are conceptual views showing arrangements of a stator blade according to a third embodiment of the present invention, in which FIG. 6(*a*) shows two pairs of the stator blades each consisting of two-divided stator blades to be overlapped so that coupling positions are shifted by 90° to each other, and FIGS. 6(*b*) to 6(*d*) show examples of the overlapping state of the pairs of stator blades.
Figure 6B:
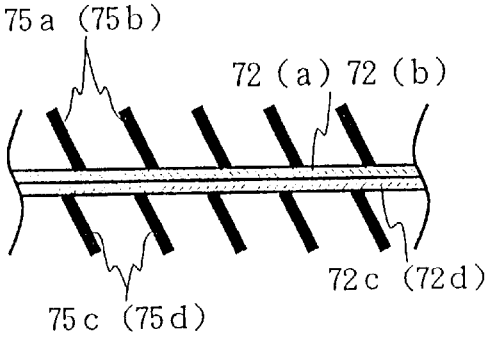
Figure 6C:
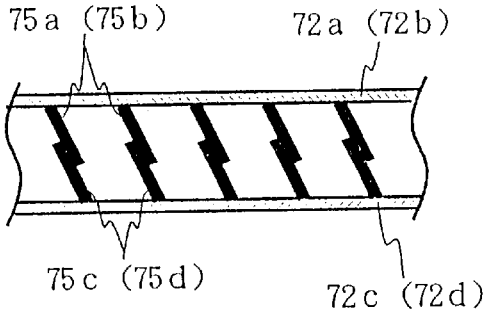
Figure 6D:
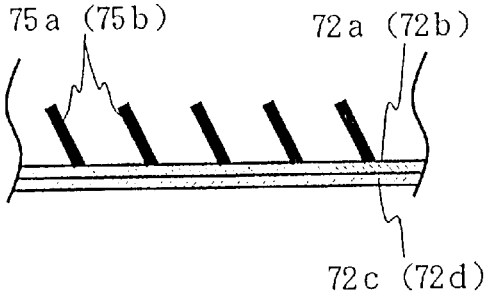

Note that the relationship between the one end portion and the other end portion of the inner ring portions 74*a* and 74*b* is the same as in modification examples shown in FIGS. 4(*a*) and 4(*b*) and FIG. 5.

As shown in FIGS. 3(*a*) and 3(*b*), in order to enhance the rigidity of the two-divided stator blades 72, reinforcing means comprised of engagement claws 81*a* and 81*b* are provided as engagement members to one of the two-divided end faces 78*a* of the inner ring portion 74. Also, provided to the two-divided end face 78*b* on the other side of the inner ring portion 74 is another engagement member in the form of an engagement claw 81*c*.

Although the dimensions of widths b1, b2, and b3 of the respective engagement claws 81*a,* 81*b,* and 81*c* in a radial direction are optional, the total value of b1+b2+b3 must be equal to or smaller than the width of the inner ring portion 74 in the radial direction. Also, the distance between the engagement claw 81*a* and the engagement claw 81*b* is required to be equal or larger than the width b2 of the engagement claw 81*c*. Furthermore, the lengths 11 of the engagement claws 81*a* and 81*b* and the length 12 of the engagement claw 81*c* are also optional. The above-mentioned relationships are the same as in the respective modification examples shown in FIGS. 4(*a*) and 4(*b*) and FIG. 5.

As shown in FIG. 3(*a*), in the engagement claws 81*a* and 81*b,* the joining portion to the inner ring portion 74*a* are curved upwardly as much of the thickness of the inner ring portion 74. Similarly, in the engagement claw 81*c,* the joining portion to the inner ring portion 74*b* is curved upwardly as much of the thickness of the inner ring portion 74.

The engagement claws 81*a*, 81*b,* and 81*c* in accordance with the present embodiment are machined by folding the engagement claw portions integrally formed. However, the curved engagement claws 81 may be separate members which are fixed to the inner ring portion 74 by welding. It is to be noted that in the case of welding or the like of the engagement claws, it may take a structure in which the engagement claws 81 are overlapped on the inner ring portion 74 and then welded. The methods of provision of the engagement claws described above are the same as in the modification examples shown in FIGS. 4(*a*) and 4(*b*) and FIG. 5.

FIG. 3(*b*) shows an engagement state of the inner ring portions 74*a* and 74*b* when a pair of the two-divided stator blades 72 is coupled.

As shown in the figure, the pair of the two-divided inner ring portions 74*a* and 74*b* are engaged with the engagement claws 81, and the rigidity against the deflection from the upper side to the down side of the drawing is improved.

It is to be noted that if it is designed such that the engagement claws are disposed to the lower side of the inner ring portion 74, the rigidity against the deflection from the lower side to the upper side of the drawing may also be improved.

FIG. 4 shows the abutting portion of the inner ring portions according to a first modification example of the second embodiment of the present invention.

In this modification example, as shown in FIG. 4(*a*), engagement claws 82*a* and 82*c* curved downwardly at the joining portion as much of the thickness of the inner ring portion 74 are provided to one end portion of the inner ring portion 74*a,* and an engagement claw 82*b* curved upwardly at the joining portion as much of the thickness of the inner ring portion 74 is provided therebetween.

Further, the other end of the inner ring portion 74*b* is a flat plate with no engagement claw, and as shown in FIG. 4(*b*), the engagement claws 82*a* and 82*c* are engaged with the lower side of the inner ring portion 74*b* and the engagement claw 82*b* is engaged with the upper side thereof.

According to the first modification example, one end portion of the pair of inner ring portions 74*a* and 74*b* are engaged with both upper and lower surfaces of the other end portion thereof through the engagement claws 82*a,* 82*b,* and 82*c.* As a result, the rigidity against the deflections from both the upper side and the lower side of the drawing may be improved.

FIG. 5 shows the abutting portion of the inner ring portions according to a second modification example of the second embodiment of the present invention.

In this modification example, as shown in FIG. 5, a sandwiching claw 83*a* is provided to one end portion of the inner ring portion 74*a,* and an engagement claw 83*b* curved upwardly at the joining portion as much of the thickness of the inner ring portion 74 is provided to the outer end of the inner ring portion 74*b.*

The sandwiching claw 83*a* is formed of a member having an L-shape in cross-section, and is configured such that an open end side of a lower horizontal bar portion of the L is attached to a face 77*a* facing to the rotor of inner ring portion 74*a,* and the lower horizontal bar portion is extended upwardly in an axial direction as much of the thickness of the inner ring portion 74, and in addition, a vertical bar portion of the L is extended in a radial direction.

In this modification example, the engagement claw 83*b* is sandwiched by the inner ring portion 74*a* and the sandwiching claw 83*a.* As a result, the rigidity against the deflections from both the upper side and the lower side of the drawing may be improved.

The sandwiching claw 83*a* is formed by cutting out a rectangular portion integrally with the inner ring portion 74*a,* and folding this rectangular portion by means of press machining in an axial direction and in an opposite direction to the axial center direction.

It should be noted that the shape of the sandwiching claw 83*a* in cross-section is not limited to L-shape, and a U-shape in cross-section may be employed. The sandwiching claw in this case has such a profile that the length 11 of the L-shape vertical bar portion of the sandwiching claw 83*a,* shown in FIG. 5, is longer than the width b2 of the engagement claw 83*b,* and the tip end thereof is further folded toward the inner ring portion 74*a.*

In addition, the sandwiching claw 83*a* may be formed separately from the inner ring portion 74*a* to fixed to the inner ring portion 74 by welding. In the case where the sandwiching claw is to be welded to the inner ring portion 74*a* by welding, the sandwiching claw may be welded not only on the face 77*a* facing to the rotor but also on the surface facing to the rotor blades 62. In this case, depending upon the welding position of the sandwiching claw 82, the position at which the engagement claw 83*b* is arranged, may be adjusted. In this way, provision of the sandwiching claw 83 on the surface facing to the rotor blades may prevent the interval between the outer periphery of the rotor body 61 from narrowing.

FIG. 6 is a conceptual view showing arrangements of a stator blade 72 according to a third embodiment of the present invention.

In the third embodiment, two-divided stator blades 72*a* and 72*b* and two-divided stator blades 72*c* and 72*d* are overlapped to constituted the stator blades 72 at the respective stages.

As shown in FIG. 6(*a*), the phase of the two-divided position of a pair of the stator blades 72*a* and 72*b* and that of the other pair of the stator blades 72*c* and 72*d* are shifted by 90° to each other to be then overlapped. It should be noted that if the phases of the divided positions of the respective pairs do not coincide with each other, the shift thereof is not limited to 90°, for example, arbitrary angle such as 30°, 45°, or 60° may be shifted.

FIGS. 6(*b*) to 6(*d*) show examples of the overlapping methods of the two pairs of the stator blades 72 according to the third embodiment of the present invention.

As a first method, as shown in FIG. 6(*b*), there is employed a case in which the upper side stator blades 72*a* and 72*b* and the lower side stator blades 72*c*and 72*d* are abutted at the outer ring portions 73 and the inner ring portions 74 to each other. As a result, the blades 75*a* and 75 and the blades 75*c* and 75*d* are disposed at the upper and lower sides, respectively.

As a second method, as shown in FIG. 6(*c*), it is configured such that the upper stator blades 72*a* and 72*b* and the lower stator blades 75*a* and 75*b* are disposed with predetermined intervals so that the blades 75*a* and 75*b* and the blades 75*c* and 75*d* are opposedly disposed to each other. It is to be noted that the given interval between the upper and lower stator blades 72 is set on the basis of a spacer disposed between the outer ring portion 73 and the inner ring portion 74 of the stator blades 72.

Figure 11A:
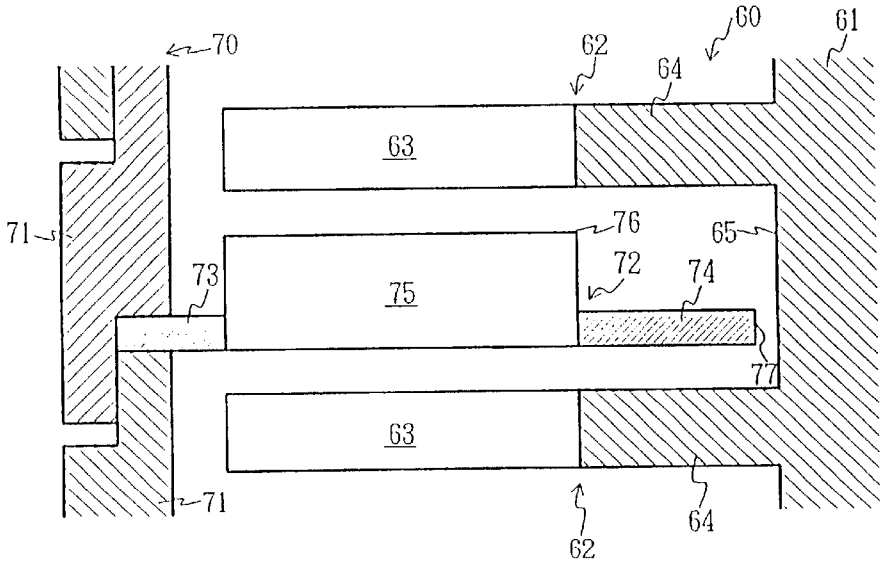
FIG.11a PRIOR ART
FIG. 11 shows the structures of a rotor blade and a stator blade of the conventional turbomolecular pump, in which FIG. 11(*a*) shows an arrangement between the rotor blade and the stator blade, FIG. 11(*b*) is a sectional perspective view showing a rotor that is cut along upper and lower planes of the rotor blade, and FIG. 11(*c*) is a perspective view showing a part of the stator blade.
Figure 11B:
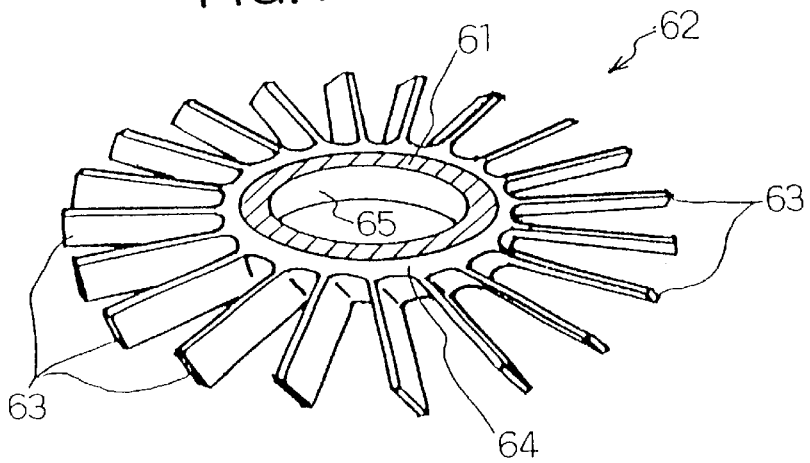
FIG.11b PRIOR ART
Figure 11C:
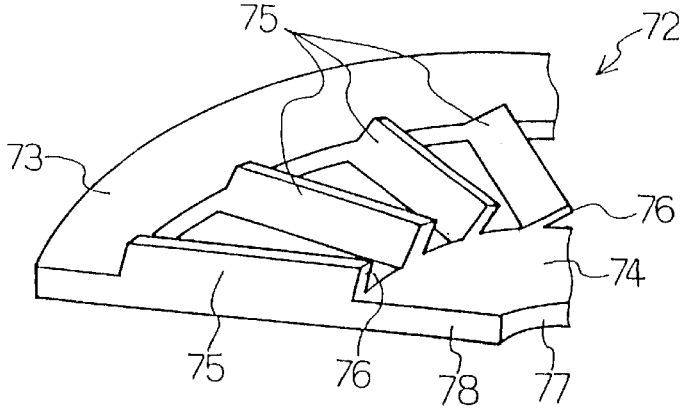
FIG.11c PRIOR ART

As a third method, as shown in FIG. 6(*d*), the conventional stator blades shown in FIG. 11(*a*) are used for the upper side stator blades 72*a* and 72*b.* Note that the lower stator blades 72*c* and 72*d* have no blades 75, and ventilation holes are formed by punching out the portions for the blades 75.

It should be noted that, in the first and second methods shown in FIGS. 6(*b*) and 6(*c*), the blades 75*a,* 75*b,* 75*c* and 75*d* having a length of a half of the conventional ones are used so that the length covering the upper and lower layers is identical with that of the conventional ones.

As described above, according to the first to third embodiments and the modification examples thereof, the rigidity of the stator blades can be improved. For that reason, the distance between the stator blades 72 and the rotor blades 62 can be made shorter than the conventional ones, thereby being capable of enhancing the down-sizing of the apparatus and the exhaust performances.

Figure 7:
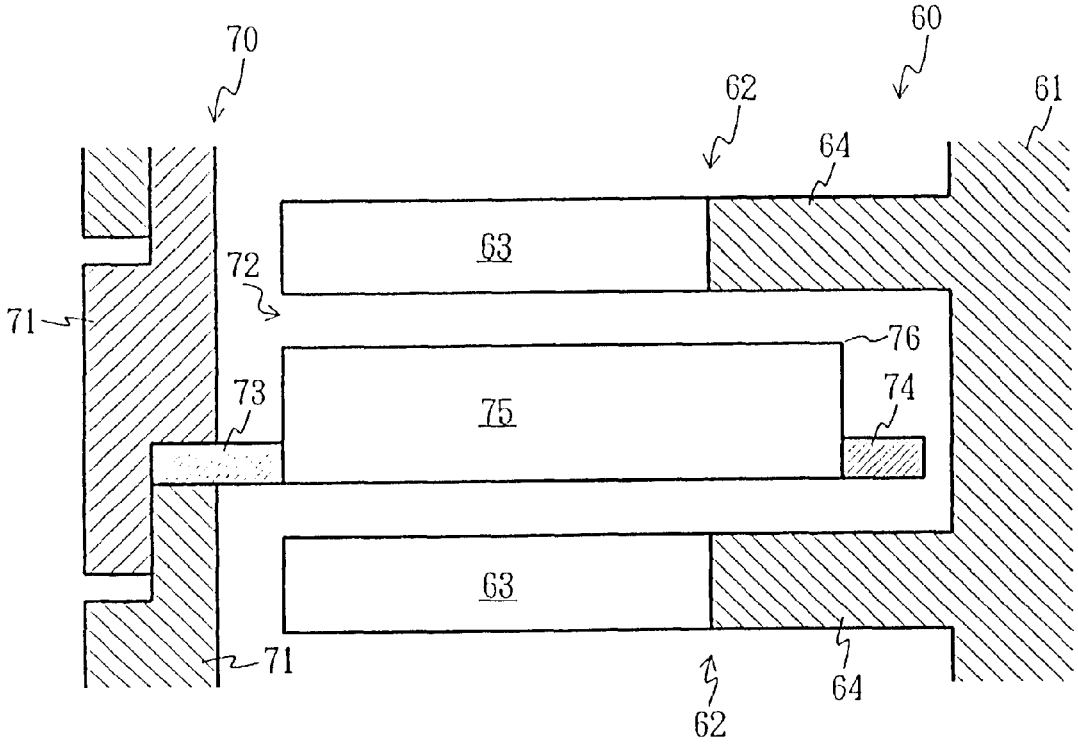
FIG. 7 is a cross-sectional view showing a stator blade and a rotor blade of a turbomolecular pump according to a fourth embodiment of the present invention.

FIG. 7 is a cross-sectional view showing the stator blades and the rotor blades of a turbomolecular pump according to a fourth embodiment of the present invention.

In this embodiment, there is employed a structure in which the blades S 75 and the blades 63 that are planes of discontinuity and are the weakest portions in structure, are prevented from contacting with each other, thereby preventing damage to the the stator blades 72 and the rotor blades 62.

Specifically, the length of the blades S 75 in a radial direction extends in an axial center direction so that the top end portions 76 of the blades S 75 on the center side are arranged between the rotor ring portions 64 and 64.

As described above, with the top end portions 76 of the blades S 75 on the center side being arranged between the rotor ring portions 64 and 64, even if the stator blades 72 are largely deflected, the top end portions 76 of the blades S 75 on the center side are brought into contact with a rotor ring portion 64 which is a plane of continuity of the rotor blades 62, thereby preventing damage to the blades S 75.

Figure 8:
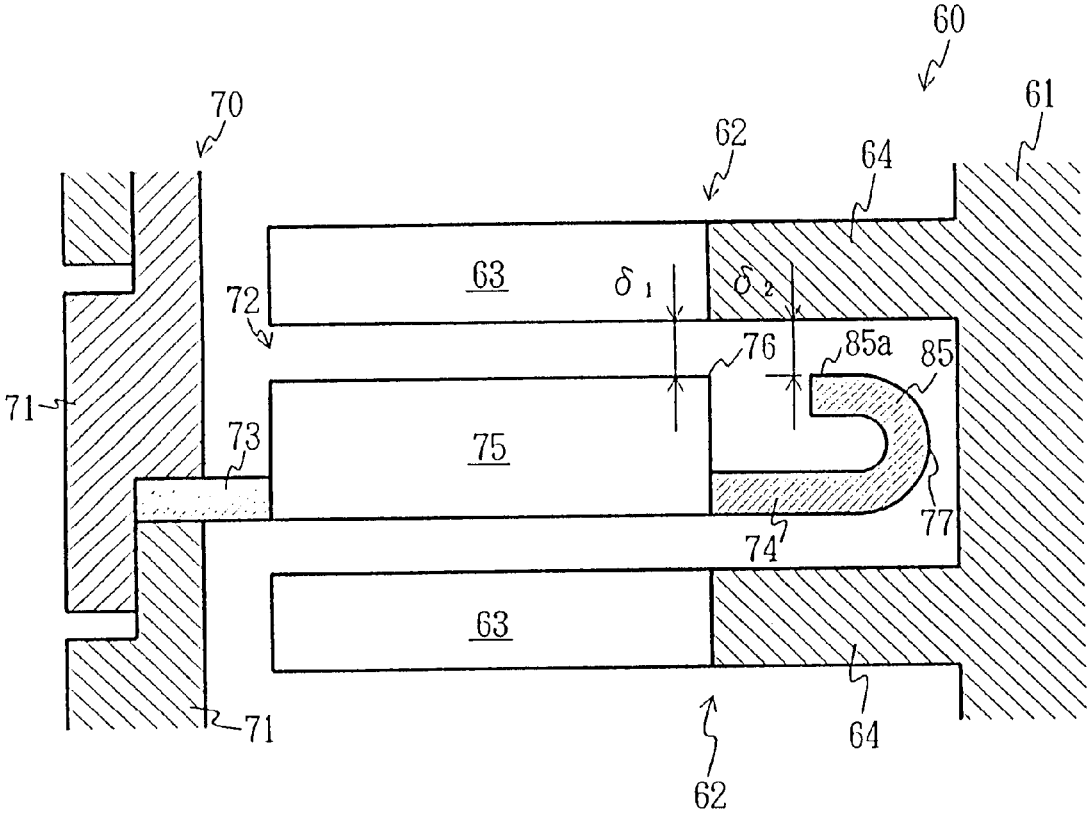
FIG. 8 is a cross-sectional view showing a stator blade and a rotor blade of a turbomolecular pump according to a first modification example of the fourth embodiment of the present invention.

FIG. 8 is a cross-sectional view showing a stator blade and a rotor blade of a turbomolecular pump according to a first modification example of the fourth embodiment of the present invention.

In this modification example, an abutting portion 85 is provided to the inner ring portion 74 of each stator blade 72, thereby preventing the blade S 75 and blades R 63 from contacting with each other.

As shown in FIG. 8, the abutting portion 85 has a substantially U-shape in cross-section, and has such a structure that the abutting portion is folded back in an opposite direction to the axial center.

Further, the abutting portion 85 is configured to satisfy the relation of $\delta 1 \leqq \delta 2 \leqq x$, where the distance between the upper most top end face 85*a* in the axial direction of the abutting portion 85 and its upper facing rotor ring portion 64 is prescribed as "δ2," and the distance between the top end face of the blades S 75 and the lower end face of the blade R 63 is prescribed as "δ1."

In this case, "X" means the distance between the upper most top end face 85*a* in the axial direction of the abutting portion 85 and it supper facing rotor ring portion 64 in the case where the upper most top end face 85*a* in the axial direction of the abutting portion 85 and the top end face 76 on the center side of the blades S 75 are simultaneously brought into contact with the rotor blades 62, when the stator blades were deflected.

In the first modification example of the fourth embodiment of the present invention, as shown in FIG. 8, the abutting portion 85 is folded back against the axial direction to have a U-shape in cross-section. As a result, the abutting portion 85 functions as a spring, thereby being capable of absorbing the impact at the time when the upper most top end face 85 is brought into contact with the rotor ring portion 64.

Figure 9:
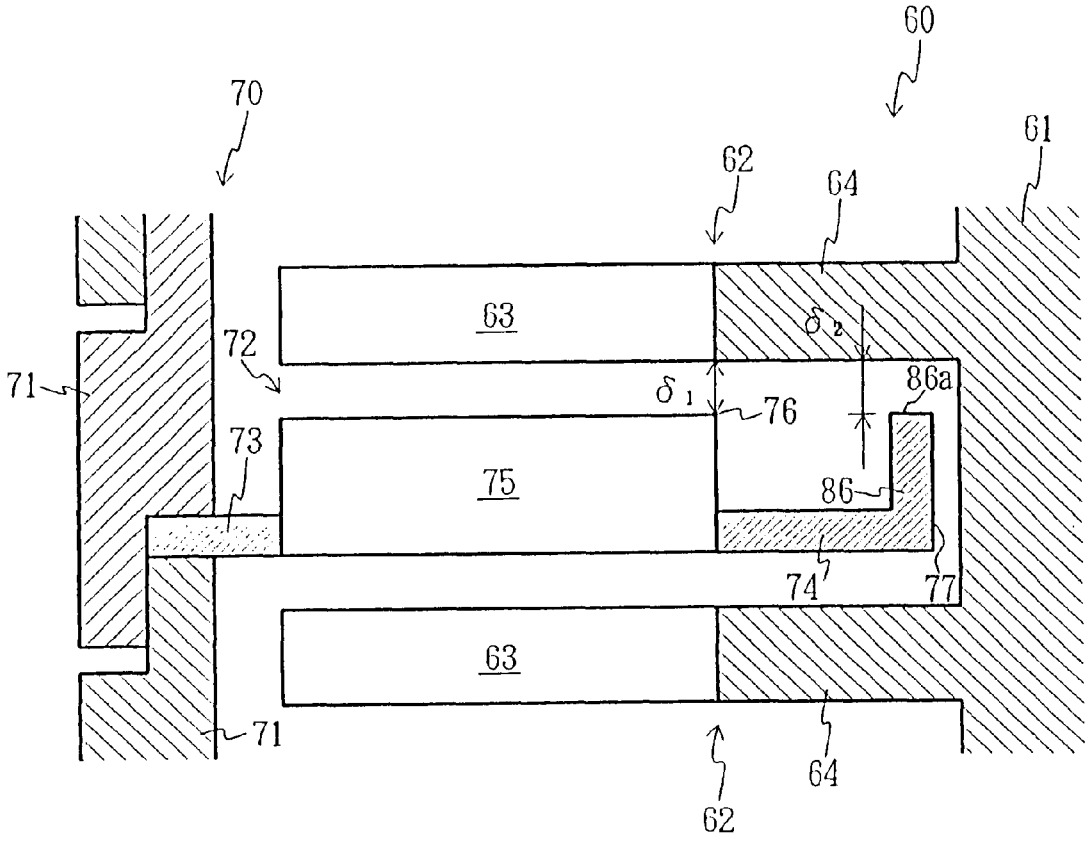
FIG. 9 is a cross-sectional view showing a stator blade and a rotor blade of a turbomolecular pump according to a second modification example of the fourth embodiment of the present invention.

FIG. 9 is a cross-sectional view showing a stator blade and a rotor blade of a turbomolecular pump according to a second modification example of the fourth embodiment of the present invention.

In this modification example, similar to the first modification example, the abutting portion that abuts against the rotor ring portion 64 is provided to the inner ring portion 74 of the stator blades 72. However, in the second modification example, an abutting portion 86 having a rectangular shape is provided to the inner ring portion 74 of the stator blades 72.

The condition relating to the distance δ2 between the top end face 86*a* of the abutting portion 86 and its upper facing rotor ring portion 64 is similar to that of the first modification example of the fourth embodiment of the present invention.

Figure 10:
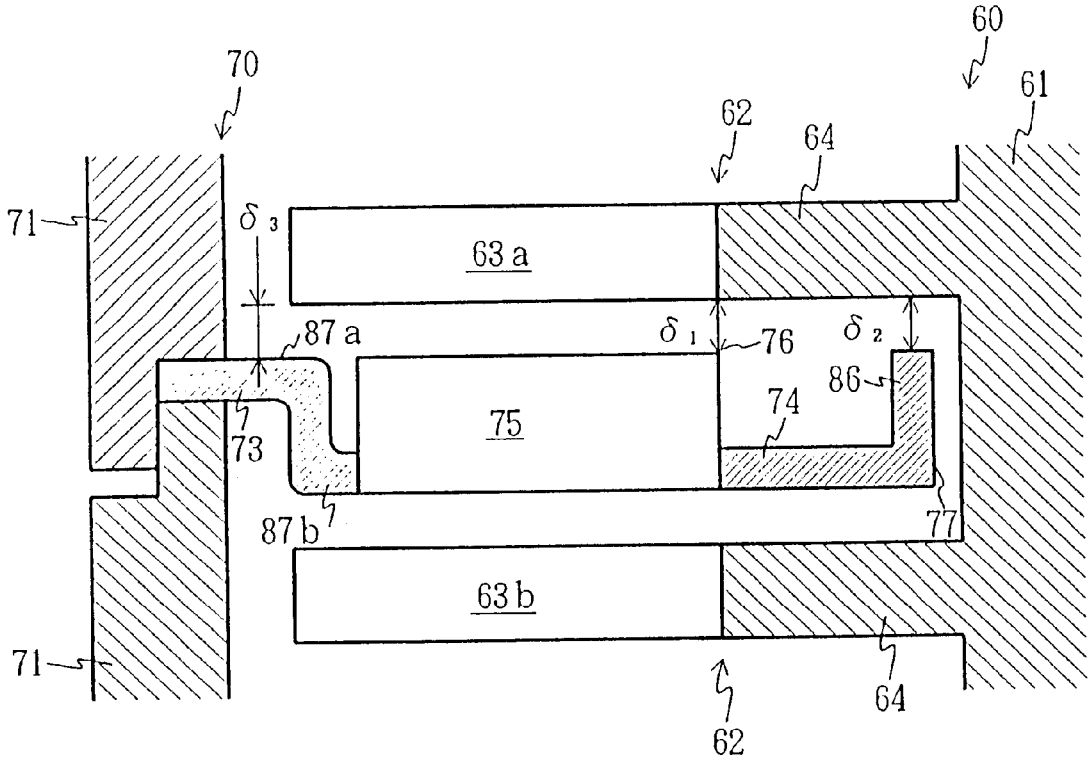
FIG. 10 is a cross-sectional view showing a stator blade and a rotor blade of a turbomolecular pump according to a third modification example of the fourth embodiment of the present invention.

FIG. 10 is a cross-sectional view showing a stator blade and a rotor blade of a turbomolecular pump according to a third modification example of the fourth embodiment of the present invention.

In this third modification example, the abutting portion 86 according to the second modification example of the fourth embodiment of the present invention is disposed to the inner ring portion 74. Also, the distance between the end portion of the blades S 75 and the spacers 71 side in a radial direction and the spacers 71 is configured to be wider than the distance between the distal end of the blades R 63*a* and 63*b* and the spacers 71 so that the length of blades S 75 in a radial direction become shorter than the length of the blades R 63*a* and 63*b*.

Further, the outer ring portion 73 of the stator blade 72 is configured to have a stepped portion between a first ring portion 87*a* on the side being sandwiched by the spacers 71 and a second ring portion 87*b* for supporting blades S 75. The stepped portion is provided to the whole outer ring portion 73 of the stator blade 72 in a circumferential direction thereof. The length of the first ring portion 87*a* in the axial direction is set to the length so that the top face thereof is positioned between the blades R 63*a* and 63*b*.

It should be noted that since the position of the first ring portion 87*a* held by the spacers 71 in the axial direction is moved to the upper than the conventional ones, the length of the spacers 71 is adjusted based on the shape of the outer ring portion 73 of the blade S 75.

The outer ring portion 73 is configured so as to satisfy the relation of $0<\delta 3<P$, where the distance between the top face of the first ring portion 87*a* and the blades R 63*a* is prescribed as s3. In this case, value "P" means the distance between the first ring portion 87*a* and the blades R 63*a* in the case where blades R 63*a* are brought into contact with the first ring portion 87*a* and the blades S 75, simultaneously, when the rotor blades 62 were deflected downwardly.

According to the thus configured third modification example of the fourth embodiment of the present invention, when the stator blades 72 were deflected, the abutting portion 86 is brought into contact with the rotor ring portion 64, thereby preventing the damage of the blades S 75.

On the other hand, in the case where the rotor blades 62 are largely downwardly deflected, the blades R 63*a* positioned at the upper portion of the outer ring portion 73 of stator blades 72 are brought into contact with the first ring portion 87*a* of the outer ring portion 73. In the case where the blades R 63*a* and 63*b* are largely upwardly deflected, the blades R 63*b* are brought into contact with the second ring portion 87*b*. Since the first and second ring portions 87*a* and 87*b* form the plane of continuity in a circumferential direction, even if the blades R 63 are brought into contact therewith, the damage of the blades R 63*a* and 63*b* can be prevented.

It should be noted that the abutting portions 85 and 86, according to the first, second, and third modification examples of the fourth embodiment of the present invention, are provided to the whole inner ring portion 74 in a circumferential direction from one end portion to the other end portion.

Alternatively, the abutting portion 85 or 86 may be provided to both one end portion and the other end portion of the inner ring portion 74. In the latter case, at least one abutting portion 85 or 86 may further be provided between one end portion and the other end portion.

As described above, descriptions have been made of the respective embodiments and their modification examples. However, the present invention is not limited thereto, various modifications may be adopted if such modifications fall within the scope of claim described in each claim.

For example, among the respective stator blades 72 described in the first, second and third embodiments of the present invention, the stator blades may be configured by a combination at least two structures. For example, the combination of the first and second embodiments allow the provisions of the rib structure (enhancement portion (reinforcement member) as well as the engagement claws for engaging one end with the other end, to the inner ring portion 74 of the stator blades 72.

Further, as another modification example of the second embodiment of the present invention, such a configuration may be employed in which a concave portion in a radial direction is formed at one end face 78*a* of the two-divided inner ring portion 74*a,* and a convex portion to be fitted to the concave portion is provide to the other end face 78*b* of the two divided inner ring portion 74*b*.

As described above, according to the first to third embodiments of the present invention, even if a large fluctuation occurred in a load of gas, since the rigidity of the stator blades 72 is improved, the deflection of the stator blades 72 is restrained. As a result, the stator blades 72 are hardly brought into contact with the rotor blades 62.

Furthermore, according to the fourth embodiment of the present invention, even if the stator blades 72 and the rotor blades 62 are brought into contact with each other, before the portions that are weak in structure (the blades S 75 and the blades 63) are brought into contact with each other, other portions are allowed to contact with each other, thereby being capable of preventing the fatal damages of the stator blades 72 and the rotor blades 62.

Even in the case where the magnetic bearing is subjected to touch down against the touch down bearing, if the structures according to the first to third embodiments of the present invention is employed, the deflection the stator blades can be prevented. If the structure according to the fourth embodiment of the present invention is used, contact between the blades can also be prevented.

As described above, according to the present invention, it is possible to provide the turbomolecular pump with stator blades having a structure in which deflections are not relatively occurred. The stator blades are hardly deflected, thereby being capable of narrowing the distance between the stator blades and the rotor blade. As a result, the downsizing of the turbomolecular pump may be realized and exhaust performances may be improved.

Further, according to the present invention, it is possible to provide a turbomolecular pump with stator blades having a structure in which even if the deflection of the stator blades occurred, since the contacts between the blades S and the blades R can be prevented, breakage of the stator blades hardly occurrs.

What is claimed is:

1. A turbomolecular pump comprising: a casing; a rotor having a plurality of rotor blades arranged in a plurality of stages in the casing axially thereof; a stator having a plurality of stator blades arranged in a plurality of stages and alternately located between the rotor blades, each of the stator blades having an inner ring portion, an outer ring portion spaced-apart from the inner ring portion, and a plurality of blades connected between the inner and outer ring portions along a circumferential direction thereof, each of the blades having a first end connected to an outer peripheral edge of the inner ring portion and a second end opposite the first end connected to an inner peripheral edge of the outer ring portion; and reinforcing means disposed on the inner ring portion of each of the stator blades along the entire circumference of the inner ring portion for reinforcing the stator blade.

2. A turbomolecular pump according to claim 1; wherein the reinforcing means comprises a rib structure.

3. A turbomolecular pump according to claim 2; wherein the rib structure is generally semicircular-shaped in cross-section.

4. A turbomolecular pump according to claim 2; wherein the rib structure is generally semielliptical-shaped in cross-section.

5. A turbomolecular pump according to claim 2; wherein the rib structure is generally U-shaped in cross-section.

6. A turbomolecular pump according to claim 2; wherein the rib structure is generally V-shaped in cross-section.

7. A turbomolecular pump according to claim 1; wherein the inner ring portion of the stator blade has a first surface and a second surface opposite the first surface; and wherein the reinforcement means comprises a protrusion extending from the first surface.

8. A turbomolecular pump according to claim 7; wherein the reinforcement means further comprises a groove formed in the second surface along the entire circumference of the inner ring portion and aligned with the protrusion in the axial direction of the casing.

9. A turbomolecular pump according to claim 1; wherein the casing has an inlet port and an outlet port so that during operation of the turbomolecular pump gas molecules are sucked in from the inlet port, compressed and discharged from the outlet port by the interaction between the rotor blades and the stator blades.

10. A turbomolecular pump according to claim 1; wherein the rotor has a rotor body and each of the rotor blades has a rotor ring portion extending from the rotor body and the blades are connected to the rotor ring portion; and wherein the inner ring portion of each of the stator blades has an abutment portion extending therefrom for contacting a respective one of the rotor ring portions of the rotor blades during substantial deflection of the stator blades in the axial direction.

11. A turbomolecular pump according to claim 1; wherein the outer ring portion of each of the stator blades has a step portion extending therefrom for contacting a respective one of the rotor blades during substantial deflection of the stator blades in the axial direction.

12. A turbomolecular pump according to claim 1; wherein the stator blades at each of the plurality of stages comprises at least two of the stator blades disposed in overlapping relation and shifted in phase relative to one another.

13. A turbomolecular pump comprising: a casing; a rotor having a plurality of rotor blades arranged in a plurality of stages in the casing axially thereof; a stator having a plurality of stator blades arranged in a plurality of stages and alternately located between the rotor blades, each of the stator blades comprising first and second semicircular parts mutually aligned and secured in place to form a ring member, each of the first and second semicircular parts having an inner ring portion, an outer ring portion and a plurality of blades connected between the inner and outer ring portions along a circumferential direction thereof, each of the blades having a first end connected to an outer peripheral edge of the inner ring portion and a second end opposite the first end connected to an inner peripheral edge of the outer ring portion; and at least one engagement member extending from a peripheral edge of the inner ring portion of each of the first and second semicircular parts of the stator blades for securing the first and second semicircular parts to one another and for reinforcing the stator blades.

14. A turbomolecular pump according to claim 13; wherein the at least one engagement member comprises two engagement members extending from an inner peripheral edge of the inner ring portion of the first semicircular part for engaging the inner ring portion of the second semicircular part and one engagement member extending from an inner peripheral edge of the inner ring portion of the second semicircular part for engaging the inner ring portion of the first semicircular part.

15. A turbomolecular pump according to claim 13; wherein the at least one engagement member comprises a generally L-shaped engagement member extending from the peripheral edge of the inner ring portion of the first semicircular part and an engagement member extending from an inner peripheral edge of the inner ring portion of the second semicircular part for engaging the generally L-shaped engagement member.

16. A turbomolecular pump according to claim 13; wherein the stator blades at each of the plurality of stages comprises at least two of the stator blades disposed in overlapping relation and shifted in phase relative to one another.

17. A turbomolecular pump comprising: a casing; a rotor having a plurality of rotor blades arranged in a plurality of stages in the casing axially thereof; a stator having a plurality of stator blades arranged in a plurality of stages and alternately located between the rotor blades, each of the stator blades comprising first and second semicircular parts mutually aligned and secured in place to form a ring member, each of the first and second semicircular parts having an inner ring portion, an outer ring portion and a plurality of blades connected between the inner and outer ring portions along a circumferential direction thereof, each of the blades having a first end connected to an outer peripheral edge of the inner ring portion and a second end opposite the first end connected to an inner peripheral edge of the outer ring portion; and a plurality of engagement members extending from an inner peripheral edge of the inner ring portion of the first semicircular part of the stator blades for engaging the inner ring portion of the second semicircular part to secure the first and second semicircular parts to one another and for reinforcing the stator blades.

18. A turbomolecular pump according to claim 17; wherein the plurality of engagement members comprise a first engagement member, a second engagement member spaced-apart from the first engagement member, and a third engagement member disposed between the first and second engagement members.

19. A turbomolecular pump according to claim 18; wherein the inner ring portion of the first semicircular part has a main surface lying in a first plane; and wherein each of the first and second engagement members has a main surface lying on the first plane.

20. A turbomolecular pump according to claim 19; wherein the third engagement member has a first leg portion and a second leg portion connected to the first leg portion to define a generally L-shaped engagement member, the first leg portion having a main surface lying on a second plane disposed generally parallel to the first plane.

21. A turbomolecular pump according to claim 17; wherein the stator blades at each of the plurality of stages comprises at least tow of the stator blades disposed in overlapping relation and shifted in phase relative to one another.

* * * * *

UNITED STATES PATENT AND TRADEMARK OFFICE

CERTIFICATE OF CORRECTION

PATENT NO. : 6,334,754 B1
DATED : January 1, 2001
INVENTOR(S) : Takashi Kabasawa It is certified that error appears in the above-identified patent and that said Letters Patent is hereby corrected as shown below:

Column 13,
Line 49, insert -- and radially spaced from an inner peripheral edge thereof -- after "portion".

Column 14,
Line 25, insert -- each of at least two of -- after "wherein".
Line 27, change "at least" to -- a pair of stator blade portions divided at a dividing line, the -- and insert -- being -- after "blades,".
Line 28, change "and" to -- to one another so that the dividing lines are --.

Signed and Sealed this

Thirteenth Day of August, 2002

*Attest:*

*Attesting Officer*

JAMES E. ROGAN
*Director of the United States Patent and Trademark Office*